US012662884B1

(12) United States Patent
Morin et al.

(10) Patent No.: US 12,662,884 B1
(45) Date of Patent: Jun. 23, 2026

(54) DIRECTED ROCK CUTTINGS AND FLUID FLOW CONCEPTS FOR AUGMENTED DRILLING

(71) Applicants: Baker Hughes Oilfield Operations LLC, Houston, TX (US); Saudi Arabian Oil Company, Dhahran (SA)

(72) Inventors: John Morin, The Woodlands, TX (US); Xu Huang, Spring, TX (US); Ahmed Hanafy, The Woodlands, TX (US); Rebecca Dar, Magnolia, TX (US); John Abhishek Raj Bomidi, Peral River, NY (US); Guodong Zhan, Dhahran (SA)

(73) Assignees: Saudi Arabian Oil Company, Dhahran (SA); Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 19/049,407

(22) Filed: Feb. 10, 2025

(51) Int. Cl.
*E21B 10/60* (2006.01)
*E21B 10/567* (2006.01)
*E21B 10/61* (2006.01)

(52) U.S. Cl.
CPC ..... *E21B 10/602* (2013.01); *E21B 10/61* (2013.01); *E21B 10/5673* (2013.01)

(58) Field of Classification Search
None
See application file for complete search history.

(56) References Cited

U.S. PATENT DOCUMENTS 3,059,708 A * 10/1962 Cannon ..... E21B 10/54 175/401
4,098,363 A * 7/1978 Rohde ..... E21B 10/26 175/391
4,452,324 A * 6/1984 Jurgens ..... E21B 10/602 299/81.3
4,711,311 A * 12/1987 Underwood ..... B05B 15/18 285/356
4,723,612 A * 2/1988 Hicks ..... E21B 10/60 175/429
4,784,231 A * 11/1988 Higgins ..... E21B 10/18 175/393
5,494,122 A * 2/1996 Larsen ..... E21B 10/18 175/393
6,082,473 A * 7/2000 Dickey ..... E21B 10/602 175/339

(Continued)

*Primary Examiner* — Blake Michener
(74) *Attorney, Agent, or Firm* — Baker Hughes Company

(57) ABSTRACT

An earth-boring tool includes a bit body having blades. Each blade has a rotationally leading surface, a rotationally trailing surface, and a formation facing surface therebetween. Each blade also has fluid courses formed between the rotationally leading surfaces and the rotationally trailing surfaces of rotationally adjacent blades. The fluid courses have a fluid course surface. The tool also includes cutting elements disposed on at least one of the blades and at least one nozzle disposed on the bit body within at least one of the fluid courses. The nozzle is adapted to be in fluid communication with a source of drilling fluid. The nozzle protrudes from the fluid course surface such that a tip of the nozzle is disposed at a distance from the fluid course surface that is greater than or equal to about 90% of a depth of the at least one of the fluid courses.

20 Claims, 8 Drawing Sheets

(56) References Cited

U.S. PATENT DOCUMENTS

| | | | | |
|---|---|---|---|---|
| 6,192,999 | B1 * | 2/2001 | Nguyen | B05B 15/14 175/393 |
| 2010/0018771 | A1 * | 1/2010 | Borissov | E21B 10/60 175/57 |
| 2010/0276206 | A1 * | 11/2010 | Borissov | E21B 10/602 76/108.1 |
| 2016/0076309 | A1 * | 3/2016 | Cuillier De Maindreville | E21B 10/602 175/393 |
| 2016/0177630 | A1 * | 6/2016 | Trunk | E21B 10/602 175/57 |
| 2022/0389765 | A1 * | 12/2022 | Morin | E21B 10/14 |
| 2025/0188806 | A1 * | 6/2025 | Morin | E21B 10/60 |

* cited by examiner

DIRECTED ROCK CUTTINGS AND FLUID FLOW CONCEPTS FOR AUGMENTED DRILLING

TECHNICAL FIELD

This disclosure relates generally to earth-boring operations. More specifically, the present disclosure relates to earth-boring tools, nozzles, and associated structures, apparatuses, and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. Common earth-boring tools use rotary drill bits, such as fixed-cutter bits (which are often referred to as "drag" bits), rolling-cutter bits, and hybrid bits. As the drill bit rotates, the cutters cut, crush, shear, and/or abrade away the formation material to form the wellbore.

Earth-boring tools may include cutting structures formed from abrasive materials having high hardness characteristics. The cutting structures may be configured to engage the formations removing material therefrom. As the cutting structures engage the formations, debris (e.g., chips, cuttings, loose material, etc.) and significant amounts of heat may be generated. If the debris and heat are not dissipated, they may contribute to premature failure of the cutting structures requiring the earth-boring tool to be removed for repair and/or replacement. This may result in significant loss of time, reducing the efficiency and increasing the costs of a drilling operation.

Accordingly, fluids may be supplied into the wellbore during the wellbore drilling operation. The fluid may be used to cool and/or clean the earth-boring tool and/or related cutting elements. For example, the fluid may cool the earth-boring tool and may clear cuttings and debris away from the earth-boring tool.

BRIEF SUMMARY

According to some aspects of the disclosure, an earth-boring tool includes a bit body having blades. Each blade has a rotationally leading surface, a rotationally trailing surface, and a formation facing surface between the rotationally leading surface of the rotationally trailing surface. Each blade also has fluid courses formed between the rotationally leading surfaces and the rotationally trailing surfaces of rotationally adjacent blades. The fluid courses have a fluid course surface. The tool also includes cutting elements disposed on at least one of the blades and at least one nozzle disposed on the bit body within at least one of the fluid courses. The nozzle is adapted to be in fluid communication with a source of drilling fluid. The nozzle protrudes from the fluid course surface such that a tip of the nozzle is disposed at a distance from the fluid course surface that is greater than or equal to about 90% of a depth of the at least one of the fluid courses. The nozzle is configured to impact a formation with a stream of drilling fluid at a point rotationally in front of at least one cutting element of the cutting elements. The at least one cutting element is configured to cut into the formation and to discharge cuttings from the formation into the stream of drilling fluid discharged by the nozzle. The at least one cutting element is at a standoff distance from about 0.1" to about 3.0" from the nozzle.

According to some aspects of the disclosure, an earth-boring tool includes a bit body having blades. Each blade has a rotationally leading surface, a rotationally trailing surface, and a formation facing surface between the rotationally leading surface of the rotationally trailing surface. Each blade also has fluid courses formed between the rotationally leading surfaces and the rotationally trailing surfaces of rotationally adjacent blades. The fluid courses have a fluid course surface. The tool also includes cutting elements disposed on at least one of the blades and at least one nozzle disposed on the bit body within at least one of the fluid courses. The nozzle is adapted to be in fluid communication with a source of drilling fluid. The nozzle protrudes from the fluid course surface such that a tip of the nozzle is disposed at a distance from the fluid course surface that is about 50% to 90% of a distance from an opposite edge to a cutting tip of a cutting face of the cutting elements. The nozzle is configured to impact a formation with a stream of drilling fluid at a point rotationally in front of at least one cutting element of the cutting elements. The at least one cutting element is configured to cut into the formation and discharge cuttings from the formation into the stream of drilling fluid discharged by the nozzle. The tip of the nozzle is at a setoff distance of about 0.2" to about 1.0" from the at least one cutting element.

According to some aspects of the disclosure, a method of forming an earth-boring tool includes forming a bit body having blades. Each blade has a rotationally leading surface, a rotationally trailing surface, and a formation facing surface between the rotationally leading surface of the rotationally trailing surface. The bit body also includes fluid courses formed between the rotationally leading surfaces and the rotationally trailing surfaces of rotationally adjacent blades. The fluid courses include a fluid course surface. The method further includes securing at least one cutting element to at least one of the blades and securing at least one nozzle to the bit body in at least one of the fluid courses. The nozzle is adapted to be in fluid communication with a source of drilling fluid. The nozzle protrudes from the fluid course surface such that a tip of the nozzle is disposed at a distance from the fluid course surface that is greater than or equal to about 90% of a depth of the at least one of the fluid courses. The nozzle is configured to discharge fluid impacting a formation at a point rotationally in front of the at least one cutting element. The at least one cutting element is configured to cut into the formation and discharge cuttings from the formation into the fluid discharged by the at least one nozzle such that the cuttings impact the formation at the point rotationally in front of the at least one cutting element. The tip of the nozzle is at a setoff distance from about 0.2" to about 1.0" from the at least one cutting element.

BRIEF DESCRIPTION OF THE DRAWINGS

For a detailed understanding of the disclosure, reference should be made to the following detailed description, taken in conjunction with the accompanying drawings, in which like elements have generally been designated with like numerals, and wherein.

DETAILED DESCRIPTION

Figure 1:
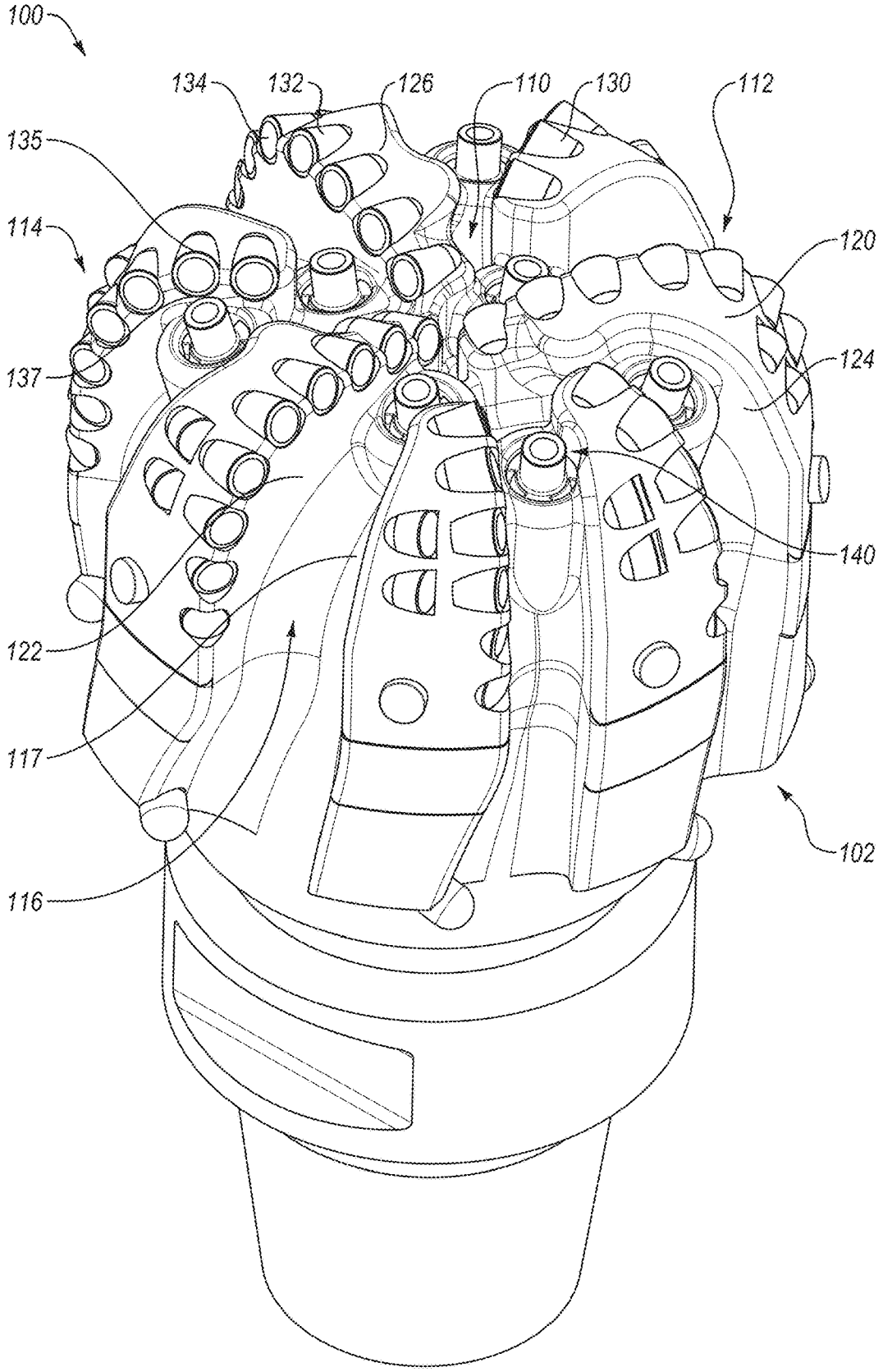
FIG. 1 is a side perspective view of an earth-boring tool in accordance with embodiments of the present disclosure.

Drawings presented herein are for illustrative purposes only and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "outlet" refers to any opening in the body of the drill bit in fluid communication with a source of drilling fluid and adapted to discharge that fluid into the borehole. As used herein, the term "nozzle cavity" refers to an outlet adapted (e.g., threaded) to receive a nozzle adapted to control or direct fluid flow out of the outlet. As used herein, the term "nozzle" or "nozzle insert" refers to any apparatus, tool, or part that is adapted to attach to the drill bit via a nozzle cavity. A nozzle may also be built into the body of the drill bit rather than be attached to a previously formed nozzle cavity.

As used herein, the terms "cutting edge" or "cutting tip" refers to a point on a cutting face (or cutting element) that contacts a formation during drilling. Typically, this will be a point on the cutting face that is closest to the formation during drilling operations.

Figure 4A:
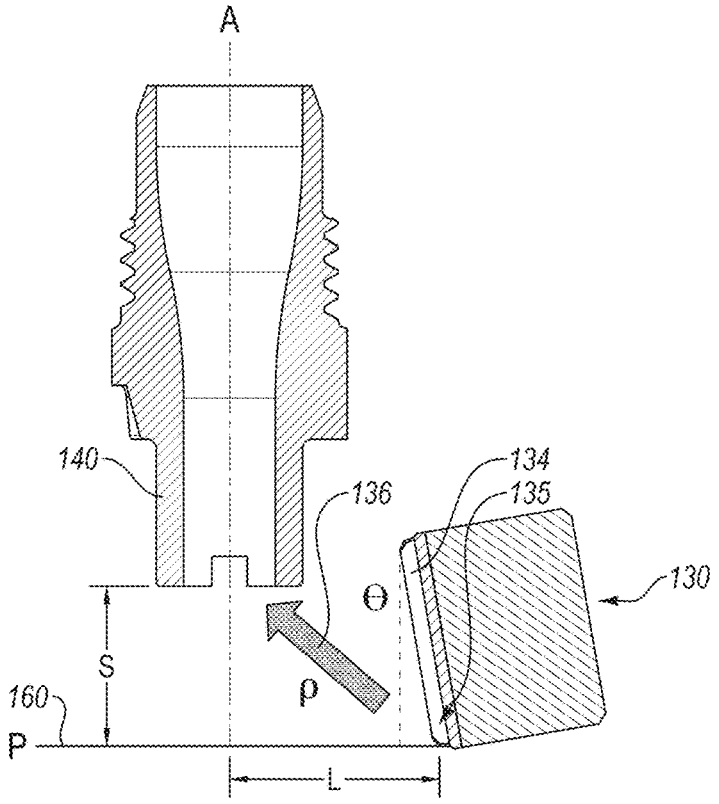
FIGS. 4A and 4B are side views of cutting elements illustrating the effect of back rake angle on cuttings.
Figure 4B:
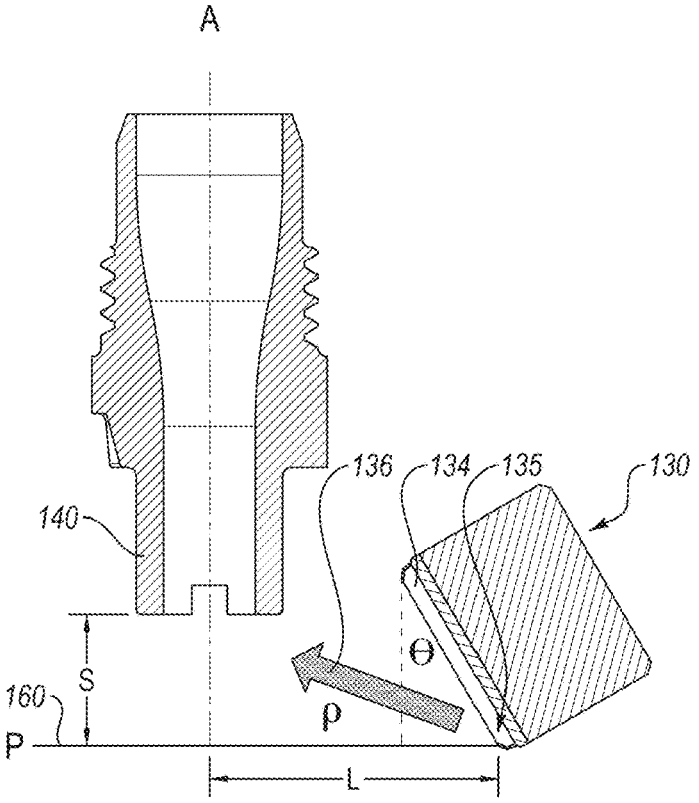

As used herein, the term "standoff distance" refers to the distance between a longitudinal axis of a nozzle and a cutting tip of a cutting element measured in a direction perpendicular to the longitudinal axis of the nozzle (see distance L in FIGS. 4A and 4B). As used herein, the term "setoff distance" refers to the distance between the outlet of a nozzle and the cutting tip of a cutting element measured along the longitudinal axis of the nozzle (see distance S in FIGS. 4A and 4B). Unless expressly indicated otherwise, standoff distance and setoff distance are only measured for pairs of cutting elements and nozzles that are positioned such that the fluid flow from the nozzle impacts a formation in front of the rotational movement of the cutting element.

As used herein, the term "back rake angle" is the angle between the face of the cutting tool and a line parallel to a longitudinal axis of the base of the tool shank (see angle θ in FIGS. 4A to 4B).

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, terms such as "ahead" and "behind" are used in reference to a direction of movement of the associated element. For example, as a drill string moves into a borehole the bottom of the borehole is ahead of the elements of the drill string and the surface is behind the elements of the drill string. In another example, in relation to a cutting element on a rotating earth-boring tool, a portion of the formation that has not yet been contacted by the cutting element is ahead of the cutting element whereas a portion of the formation that has already been contacted by the cutting element is behind the cutting element. Also, in relation to components on a rotating earth-boring tool, a component of the earth-boring tool (e.g., a blade or cutting element) is ahead of other components and behind some other components relative to the direction of rotation and any given point in the wellbore (e.g., every blade is ahead of at least one blade and behind at least one other blade).

FIG. 1 illustrates an earth-boring tool according to embodiments of the present disclosure. The earth-boring tool is a fixed-cutter type rotary drill bit 100, which includes a bit body 102 having radially protruding and longitudinally extending blades 120 thereon. The bit body 102 may be secured to a steel shank (not shown), which is used to couple the drill bit 100 to the end of a drill string. The bit body 102 of the drill bit 100 may be formed from steel. Alternatively, the bit body 102 may be formed from a particle-matrix composite material. Such materials include hard particles randomly dispersed throughout a matrix material (often referred to as a "binder" material). Such bit bodies 102 typically are formed by embedding a steel blank in a volume of particulate carbide material (e.g., tungsten carbide, titanium carbide, tantalum carbide, etc.) within a graphite mold and infiltrating the particulate carbide material with a matrix material, such as a copper-based alloy. Drill bits that have a bit body formed from such a particle-matrix composite material may exhibit increased erosion and wear resistance, but lower strength and toughness relative to drill bits having steel bit bodies.

The blades 120 have a rotationally leading surface 122, a rotationally trailing surface 124 opposite the leading surface 122, and a radially outer formation-facing surface 126. The rotationally leading surface 122 of a first blade, the rotationally trailing surface 124 of another blade, and the bit body 102 between them together define a fluid course 116. The fluid course may comprise a fluid course surface 117 which is a surface between the trailing surface 124 and a leading surface 122 of rotationally adjacent blades 120. The fluid course surface 117 may comprise a curved or rounded surface and/or may comprise a planar surface.

As is known in the industry, the bit body 102 includes different regions referred to as the cone region 110, the nose region 112, the shoulder region 114, and the gage region. A longitudinal bore (not shown) extends through the steel shank and partially through the bit body 102. Fluid passageways (not shown) extend through the bit body 102 from the longitudinal bore to nozzles 140 located in the bit body 102 on the fluid course surface 117 within the fluid courses 116. Fluid may flow through the longitudinal bore and fluid passageways, and may discharge through the nozzles 140 to cool the drill bit 100 and to entrain and remove cuttings and debris from the wellbore. The bit body 102 may be formed with nozzle receptacles to which a nozzle is attached or may be formed with nozzles in place.

A plurality of cutting elements 130 are secured to each of the blades 120 close to the junction between the leading surface 122 and the formation-facing surface 126 and/or on the formation-facing surface 126. The cutting elements 130 are equipped with a hard, abrasive cutting table 132. The cutting elements 130 may be, for example, polycrystalline diamond compact (PDC) cutting elements, which have a diamond table disposed on a cemented tungsten carbide substrate. Each cutting element 130 may be secured to the blade within a cutting pocket formed in the blade 120, such as through welding, soldering, brazing, etc.

In accordance with embodiments of the present disclosure, one or more of the nozzles 140 may comprise fluid impact nozzles 140. In accordance with embodiments of the present disclosure, fluid impact nozzles 140 are located and configured to discharge pressurized fluid against the adjacent formation surfaces at relatively high pressure to weaken and/or erode the material of the formation during drilling and assist in the cutting action performed by the cutting elements 130.

The cutting table 132 of the cutting elements may comprise a cutting face 134 adapted to cut into a formation and produce cuttings. The cutting faces 134 may be designed to direct substantially all the cuttings in a predetermined trajectory. In various embodiments, the fluid impact nozzles 140 may be located in front of a cutting face 134 such that the cuttings are directed into the path of the fluid being discharged by the nozzles 140. In this manner, cuttings dislodged by the cutting elements 130 become entrained in the fluid flow from the nozzles 140 and impact the formation causing damage to the formation beyond what would be caused by the fluid alone.

During drilling operations, the drill bit 100 is positioned at the bottom of a wellbore and rotated about a longitudinal axis. A weight-on-bit (WOB) is applied to the drill bit 100 and drilling fluid is pumped down the drill string to the longitudinal bore, through internal fluid passageways (not shown), and out of the nozzles 140. When the drill bit 100 rotates, the cutting face 134 of the cutting elements 130 may contact the earth formation and remove material. The material removed by the cutting face 134 may be entrained in the fluid flow from the nozzles 140, and the fluid along with the removed material may impact the formation. The fluid may then be removed through the fluid courses 116. In the industry, the portion of the fluid courses 116 in a gage region of the drill bit 100 are commonly referred to as junk slots. In some embodiments, the drill bit 100 may include additional nozzles 140 in the fluid courses 116 which may introduce fluid, such as water or drilling mud, into the area around the blades 120 to aid in removing the sheared material and other debris from the area around the blades 120 and/or to cool the cutting elements 130 and the blade 120 to increase the efficiency of the drill bit 100.

The fluid impact nozzles 140 may project above the fluid course surface 117 of the fluid course 116 in a direction substantially perpendicular to the fluid course surface 117 of the fluid course 116 to position the nozzles 140 closer to the cutting table 132 of the cutting elements 130 and closer to the formation. The outlet of the nozzles 140 may be at a height less than, equal to, or greater than the depth of the fluid courses 116 (e.g., a height from a lowest point of the fluid course surface 117 at the location of the nozzle 140 to the formation-facing surface 126) but below the cutting tip 135 of the cutting face 134. By keeping the nozzle 140 below the cutting tip 135, contact between a formation and a nozzle 140 may be avoided.

During drilling operations, the cutting elements 130 suffer wear and degradation such that they become smaller with time. In addition, cutting elements 130 may fracture and break or may be broken off the drill bit body 102 entirely. The likelihood of such wear and breakage is a function of multiple variables including the nature of a formation, the design of the drill bit tool, and operating conditions (e.g., WOB, RPM). Positioning the outlet of the nozzle 140 below the height of the blade 120 (e.g., below the formation-facing surface 126 of rotationally adjacent blades 120) effectively eliminates the risk of nozzle damage due to contact with the formation.

In various embodiments, the outlet of the nozzle 140 is positioned at a height that is at least about 90% of the depth of the fluid course 116. In various embodiments, the outlet of the nozzle 140 is positioned at a height such that the outlet is at substantially the same location as an opposite edge 137 of the cutting face 134 of the cutting element 130 that is opposite the cutting tip 135. In some embodiments, the outlet of the nozzle 140 is positioned within a range extending from and including the opposite edge 137 of the cutting face 134 to a position up to and including about 90% of a distance from the opposite edge 137 to the cutting tip 135 (e.g., 90% of a diameter of the cutting face 134 of the cutting element 130). In various embodiments, the nozzle is positioned from about 50% to about 90% of the distance from the opposite edge 137 to the cutting tip 135 (prior to any wear) of the cutting element 130.

The direction in which cuttings are projected from the cutting elements 130 is at least in part a function of the shape and design of the cutting faces 134 on the cutting elements 130. The angle, relative to the formation, at which the cuttings are projected is at least in part a function of the back rake angle of the cutting elements 130 and cutting faces 134. The direction and angle of the cuttings define the trajectory of the cuttings.

Figure 2A:
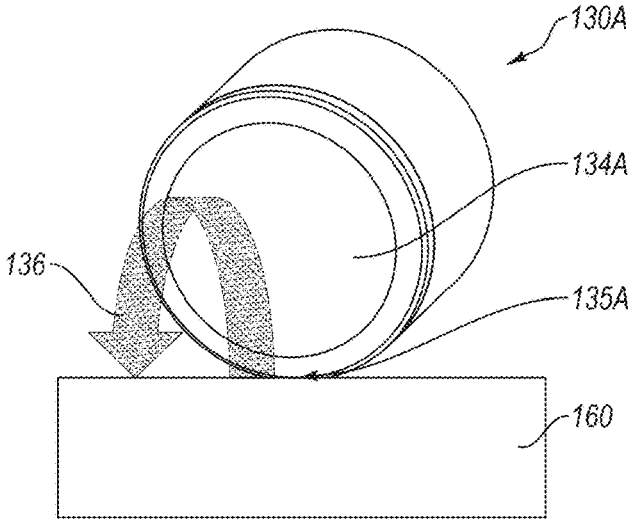
FIGS. 2A to 2C are perspective views of three cutting elements in accordance with embodiments of the present disclosure.
Figure 2B:
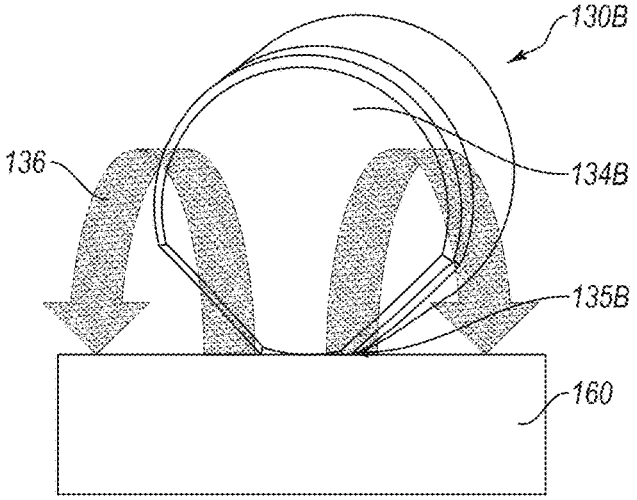
Figure 2C:
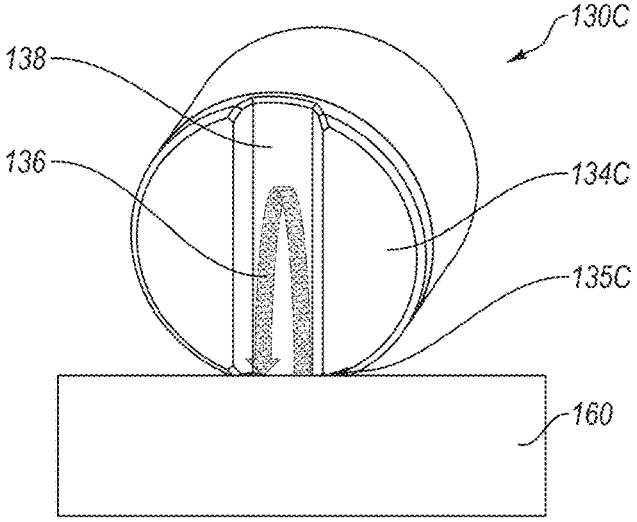

FIGS. 2A to 2C illustrate how cuttings dislodged from a formation 160 may be projected by three different cutting elements 130A, 130B, and 130C; cutting faces 134A, 134B, and 134C; and cutting tips 135A, 135B, and 135C when used on the drill bit 100. The illustrated cutting elements 130A, 130B, and 130C may be disposed on blades similar to the cutting elements 130 disposed on the blades 120 shown in FIG. 1 with cutting faces 134A, 134B, and 134C generally perpendicular to a direction of motion. The orientation of the cutting elements 130A, 130B, and 130C and faces 134A, 134B, and 134C may be configured to direct the cuttings differently from one another. Referring to FIG. 2A, the cutting face 134A has a shallow, wide chamfer around the outer edge. The cuttings 136 are generally projected straight ahead (e.g., approximately perpendicular to the cutting face 134A) of the cutting face 134A. Referring to FIG. 2B, the cutting face 134B has a relatively narrower chamfer around the outer edge of the cutting element 130B. The cuttings 136 are projected across a relatively wider range of angles to either side of a plane perpendicular to the cutting face 134B. Referring now to FIG. 2C, the cutting face 134C has a shallow channel 138 inset into the cutting face 134C creating a recessed cutting tip 135C. The cuttings 136 are projected straight ahead (e.g., approximately perpendicular to the cutting face) with a narrower spread relative to the cutting face 134A of FIG. 2A.

Figure 3A:
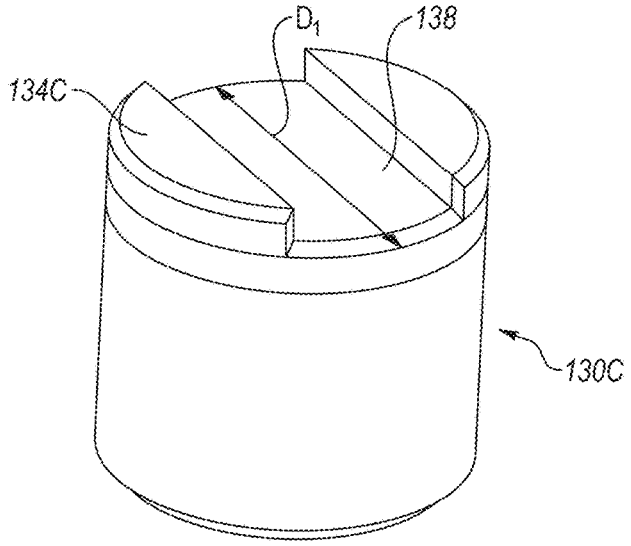
FIGS. 3A to 3C are perspective (FIG. 3A), side plan (FIG. 3B), and partial top plan (FIG. 3C) of the cutting element of FIG. 2C.
Figure 3B:
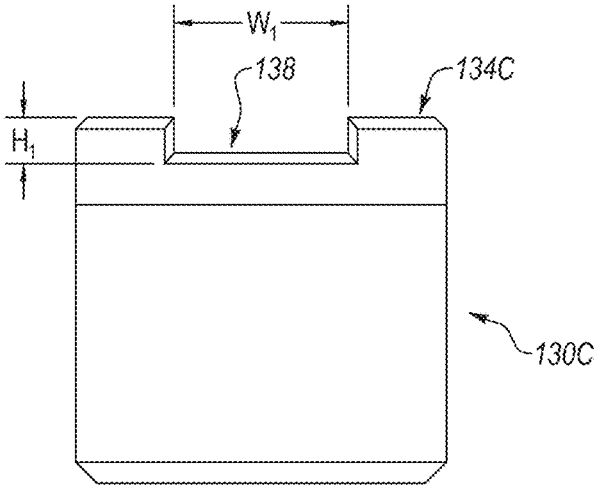
Figure 3C:
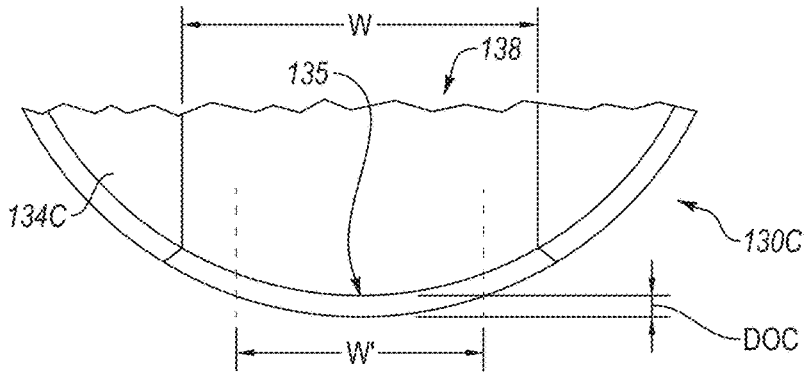

FIGS. 3A to 3C provide different views of the cutting element 130C shown above in FIG. 2C. FIG. 3A is a perspective view of the cutting element 130C. The cutting element 130C has a diameter $D_1$. FIG. 3B is a side view of the cutting element 130C showing an end view of the channel 138. The channel 138 has a width $W_1$ and a height (or depth) $H_1$. FIG. 3C is a partial top view of the cutting element 130C showing the end or edge of the channel 138. The channel 138 has a width $W_1$ that may be wider than the width W' of the cutting edge 135 (i.e., the width of the portion of the cutting element 130 in contact with a formation). The cutting element 130 also has a depth of cut DOC that is a function of the curvature of the cutting element 130 and the width W' of the cutting edge as well as the weight on bit (WOB). In various exemplary embodiments, $W_1$ may be from about 0.125" to about 0.500", $H_1$ may be from about 0.010" to about 0.100", $D_1$ may be from about 0.125" to about 1.000", W' is less than W, and DOC may be from about 0.010" to about 0.125". Other cutting face geometries may be used to determine the size, shape, and flow of cuttings, such as geometries designed to break cuttings into smaller chips.

FIGS. 4A and 4B illustrate the interaction of the cutting elements 130 and the nozzles 140 on drill bit 100. They also illustrate how the trajectory of cuttings 136 may be controlled by selection of back rake angle θ to project the cuttings 136 into a jet of fluid from the nozzle 140. The precise arrangement of the cutting elements 130 and nozzles 140 may vary depending on the requirements of a particular drilling operation (e.g., the nature of the formation to be drilled). The cutting element 130 and nozzle 140 are positioned on a drill bit (e.g., drill bit 100) such that the cutting element 130 is located away from a longitudinal axis A of the nozzle 140 at a standoff distance L. The nozzle 140 is positioned above the plane P (e.g., above the cutting tip 135 and the formation 160) at a chosen setoff distance S. The cutting element 130 is positioned such that the cuttings 136 are projected at a speed and angle to be entrained into the fluid flow from the nozzle 140 while not impacting the drill bit. The combination of standoff distance L and setoff distance S help define the minimum and maximum angle of cutting trajectories, which are adjusted by selecting an appropriate back rake angle θ. In various exemplary embodiments, the setoff distance S may be from about 0.2" to about 1.0" and the standoff distance L may be from about 0.1" to about 3.0". The back rake angle θ may also affect the size of the chips or cuttings 136 produced and may be adjusted to provide cuttings 136 that are optimally sized for entrainment in the fluid flow and/or impact on a formation 160. The side rake angle may also be adjusted to direct the flow of cuttings based on the orientation of the cutting element 130 within the blade 120. In various embodiments, the side rake angle may be from about 0° to 20°.

The back rake and side rake angles may be chosen based on a formation, and cutting elements 130 may be positioned within the blade 120 accordingly. The position of the nozzle 140 may be adjusted based on the expected trajectory of the cuttings 136 from the cutting elements 130. Referring to FIG. 4A, the back rake angle θ is at a low angle of about 10° and the cuttings 136 are projected at a relatively high angle ρ. Referring to FIG. 4B, the back rake angle θ is raised to a higher angle of about 30° and the cuttings 136 are projected at a relatively lower angle ρ. The desired angle ρ, or range of angles, of the cuttings 136 will depend in part on the placement and design of the cutting elements 130 and nozzles 140 as well as the type of formation in which the tool is to be used. In various exemplary embodiments, the back rake angle θ may be from about 10° to about 30°. As shown in FIGS. 4A and 4B, a higher back rake angle θ provides a lower trajectory angle ρ for the cuttings making it possible to reduce the setoff distance S and increase nozzle jet impact on a formation. Conversely, a lower back rake angle θ allows the standoff distance L to be decreased.

In some embodiments, all the cutting faces 134 of the cutting elements 130 of the drill bit 100 may be set at the same back rake angle θ. In other embodiments, the back rake angle θ of the cutting faces 134 vary across different parts of the drill bit (e.g., in the cone region 110, nose region 112, or shoulder region 114 of the drill bit 100). Other variables, such as side rake angle, WOB, and rotational speed (RPM), may also be used to manipulate chip formation and flow characteristics.

Figure 5A:
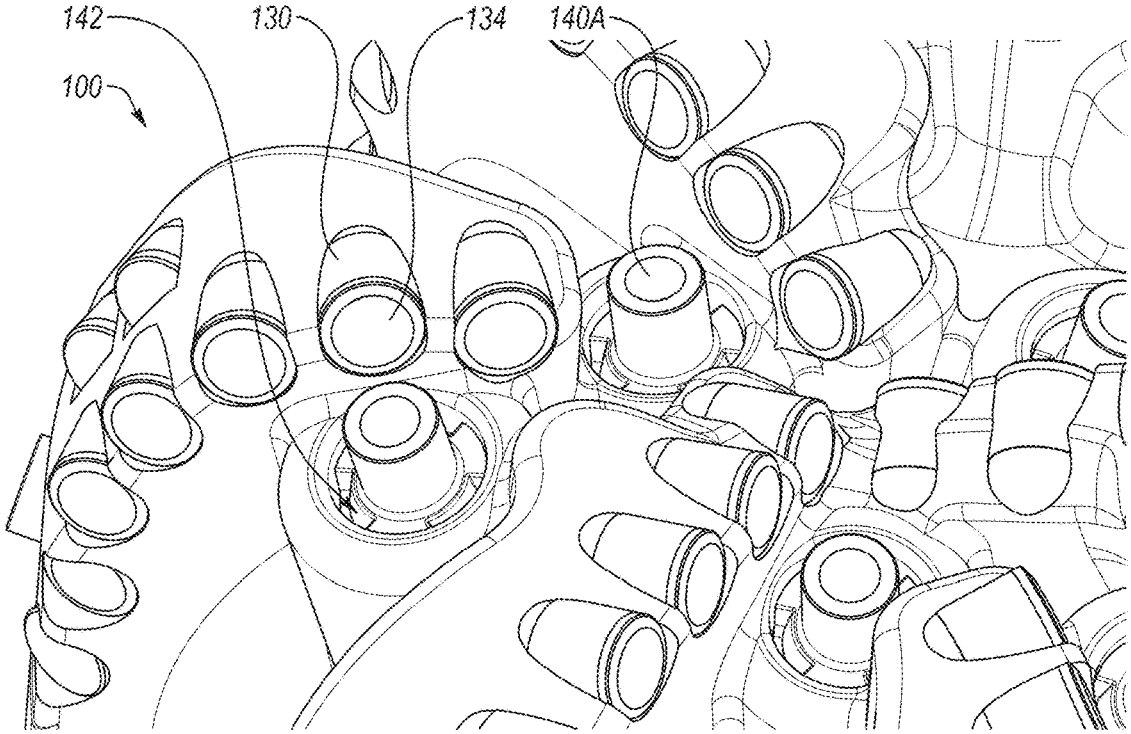
FIGS. 5A and 5B are partial perspective views of earth-boring tools with nozzles in accordance with embodiments of the present disclosure.
Figure 5B:
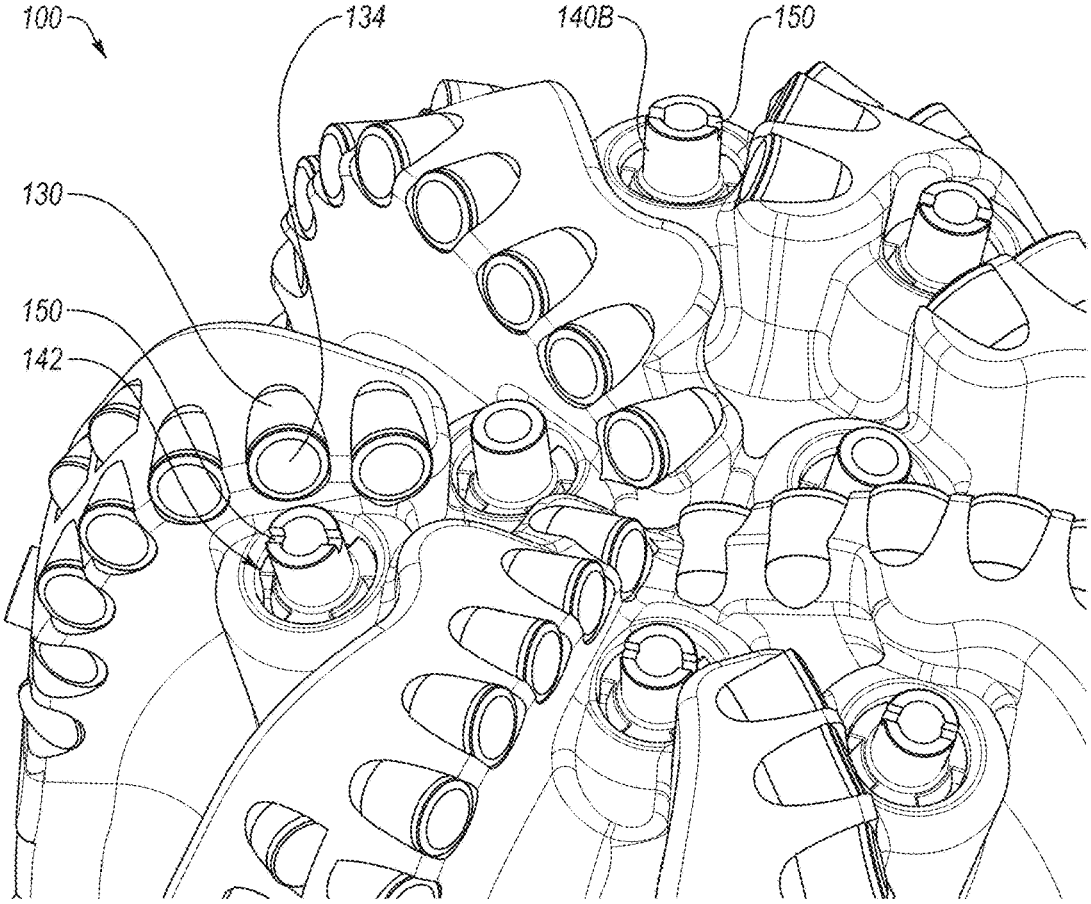

The shape of the nozzles 140, whether ports or nozzles, defines the nature of the fluid flow out of the nozzles 140. The nozzles 140 may be designed to have a very narrow, focused flow path or a more diffuse or spread flow path. FIGS. 5A to 5B illustrate exemplary nozzles 140A, 140B, which may be incorporated onto the drill bit 100 having different flow patterns. The nozzles 140A and 140B are attached to the bit body 102 via nozzle receptacles 142. Referring to FIG. 5A, the nozzles 140A have a circular opening in a flat face. The flow from nozzles 140A will be the same diameter as the opening. Referring to FIG. 5B, the nozzles 140B also have a circular opening, but there is a channel 150 (shown in greater detail in FIGS. 6A to 6C) cut into the face of the nozzle 140B that allows the fluid to expand to the sides (i.e., into the channel side openings) to create a fanned flow that is more dispersed than the flow created by nozzles 140A. Fanning the flow with nozzles 140B reduces the impact force from the flow at any given point because it distributes its impact force across a larger area of the formation's surface. However, at least some of that reduced impact is mitigated as cuttings are directed into a substantial portion of the flow and impact the formation surface. In various embodiments, the nozzle 140B is oriented such that the length of the channel 150 is substantially parallel to the plane of the cutting faces 134 cutting elements 130 that follow the nozzle 140B in the direction of rotation. Thus, the nozzle 140B may produce a fan-shaped flow of fluid that is substantially parallel to the cutting faces 134 of the cutting elements 130 that follow the nozzle 140B in the direction of rotation.

Figure 6A:
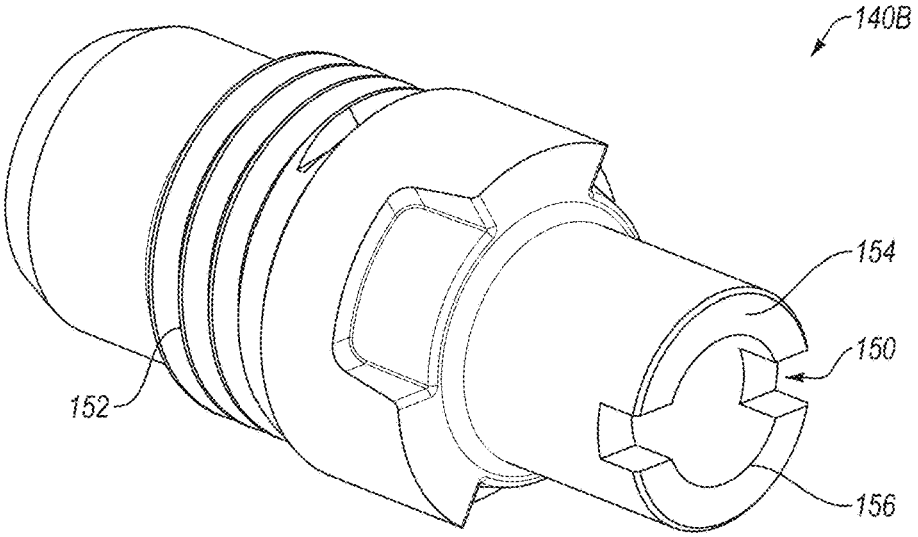
FIGS. 6A to 6C are perspective (FIG. 6A), side plan (FIG. 6B), and top plan (FIG. 6C) views of the nozzles of FIG. 5B.
Figure 6B:
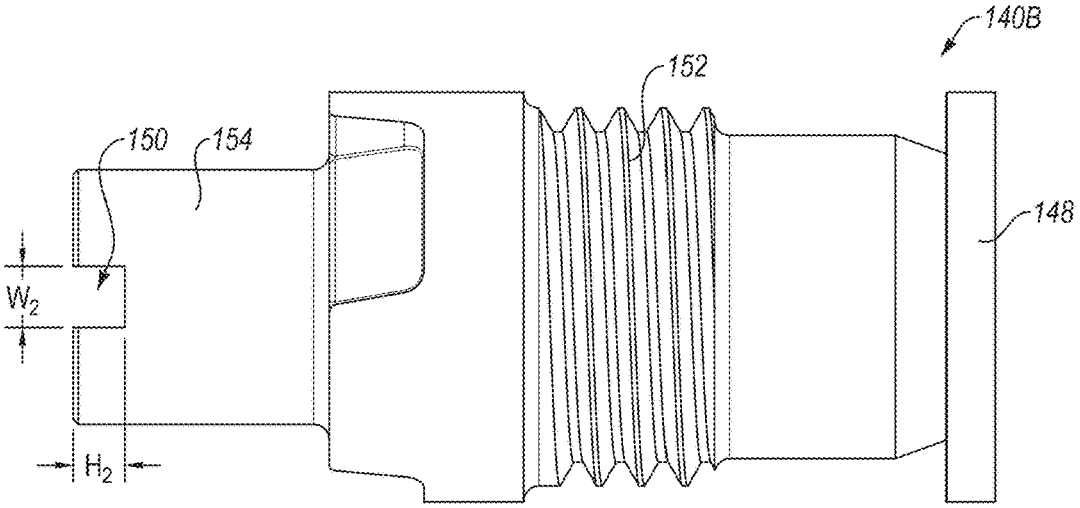
Figure 6C:
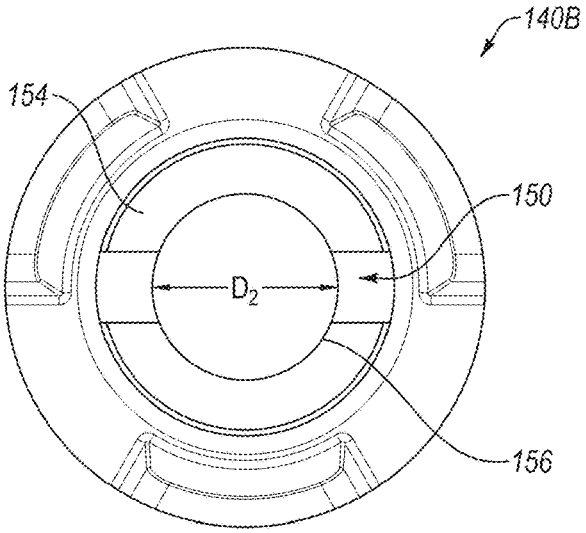

FIGS. 6A to 6C are various views of nozzle 140B. FIG. 6A is a perspective view of nozzle 140B. The nozzle 140B has a threaded base 152 adapted for attachment to a threaded nozzle receptacle 142. The nozzle tip 154 has a circular shape bisected by a rectangular channel 150. The nozzle outlet 156 is also circular except where bisected by the rectangular channel 150. FIG. 6B is a side view of the nozzle 140B. The rectangular channel 150 has a width $W_2$ and a height (or depth) $H_2$. In order to ensure that the nozzle 140B is tightly threaded into the nozzle receptacle 142 while being properly oriented (i.e., that the channel 150 is oriented to the appropriate position relative to the cutting elements), one or more shims 148 of appropriate thickness may be inserted into the bottom of a nozzle receptacle 142 prior to installation of the nozzle 140B. FIG. 6C is a top view of the nozzle 140B. The circular nozzle outlet 156 has a diameter $D_2$. In various embodiments, $H_2$ may be from about 0.050" to about 1.000", $W_2$ may be from about 0.050" to about 0.500", and $D_2$ may be from 0.125" to about 1.000". In some embodiments, the channel 150 may comprise a differently shaped profile other than rectangular, such as a half-cylinder shape in profile. Thus, the channel 150 is not limited to the shape shown in FIGS. 5B-6C.

Figure 7B:
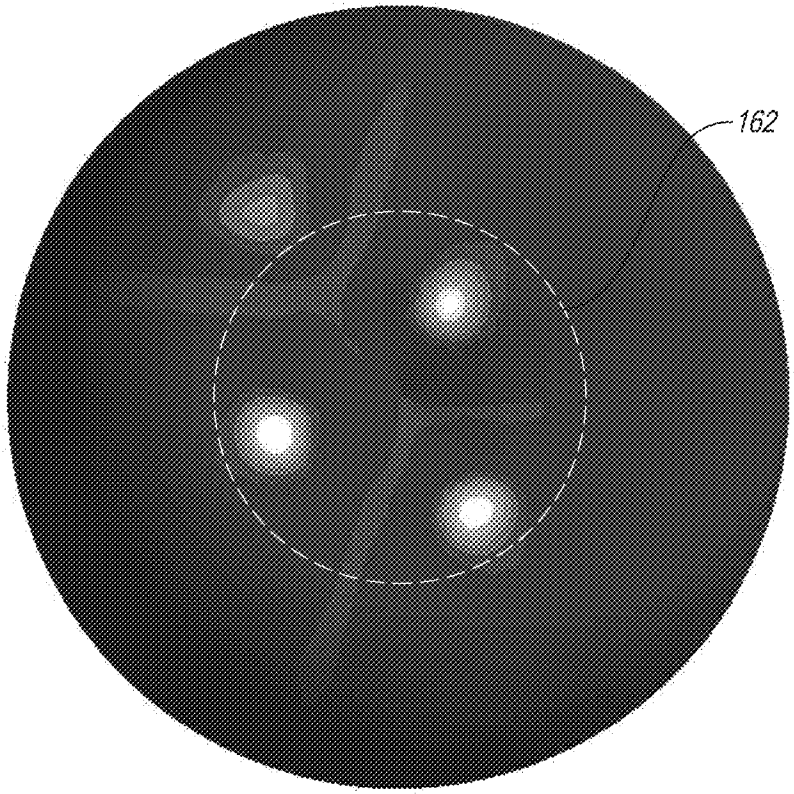
FIG. 7B illustrates impact zones of the nozzles in FIG. 7A.
Figure 7A:
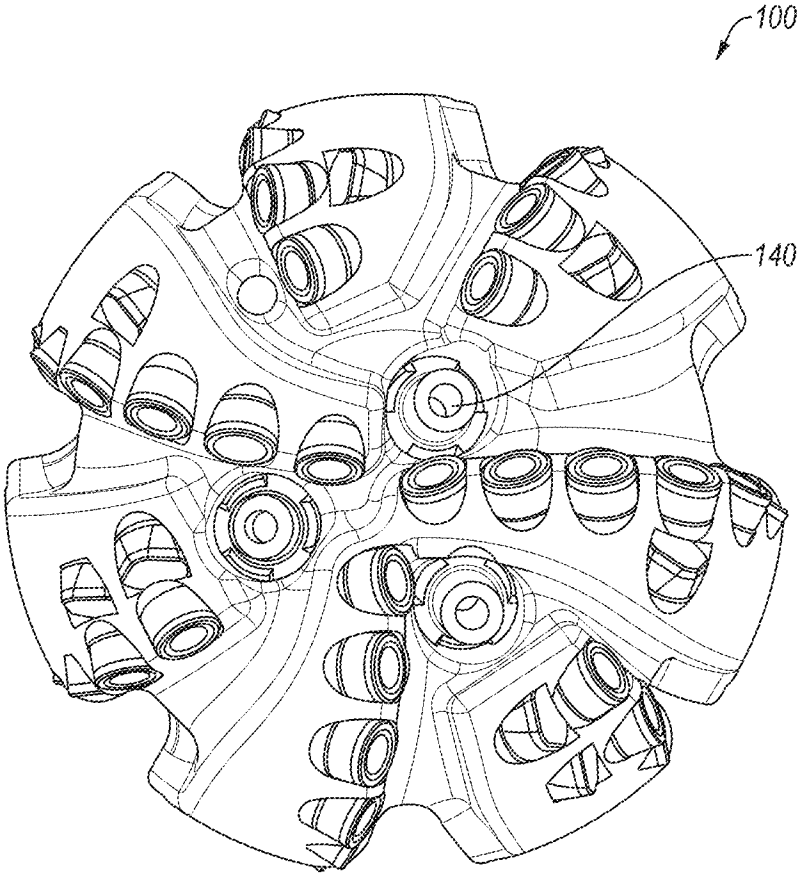
FIG. 7A is a top view of an earth-boring tool in accordance with embodiments of the present disclosure.

Referring to FIGS. 7A to 7D, embodiments of an earth-boring tool illustrating exemplary fluid impact nozzle positioning on a drill bit, such as drill bit 100, are shown. In FIG. 7A, each of the fluid impact nozzles 140 are positioned at approximately the same radial distance from a central axis of the drill bit 100. FIG. 7B shows how the arrangement of nozzles in FIG. 7A creates a small but focused area of impact 162 near the center of the drill bit 100 and wellbore. Placing all the fluid impact nozzles 140 in the central or cone region of the tool provides a concentrated "attack" on the formation at the center of the borehole.

Figure 7D:
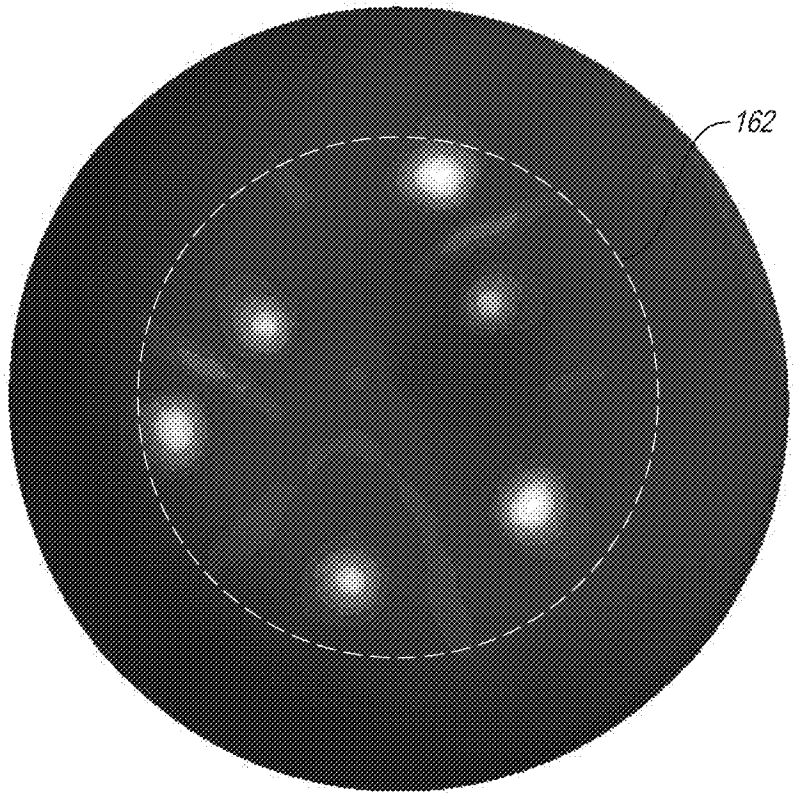
FIG. 7D illustrates impact zones of the nozzles in FIG. 7C.
Figure 7C:
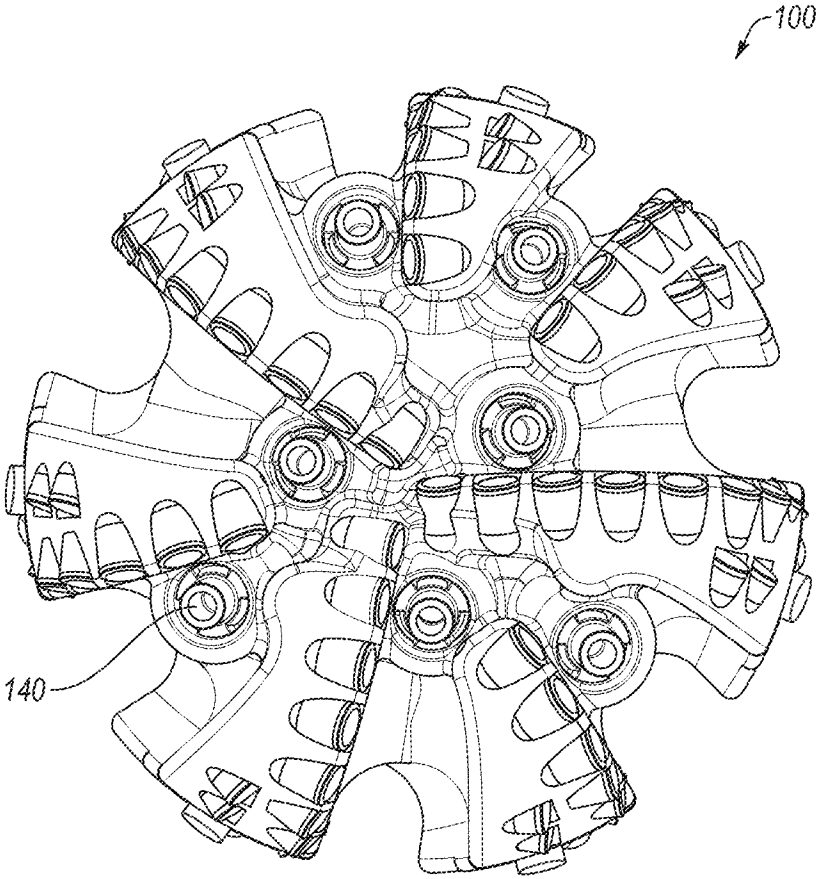
FIG. 7C is a top view of another earth-boring tool in accordance with embodiments of the present disclosure.

Referring now to FIG. 7C, each of the fluid impact nozzles 140 are positioned at different radial distances from the central axis of the drill bit 100. As shown in FIG. 7D, the fluid nozzles impact a larger area of impact 162 of the formation. It will be understood by persons of skill in the art that the number of fluid nozzles and blades may be more or less than illustrated depending on the overall design of the earth-boring tool and the types of formations for which the tool is designed. Persons of skill in the art will also recognize that the arrangement of the fluid nozzles relative to the central axis may depend on the intended use of a particular earth-boring tool.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth-boring tool, comprising:

a bit body comprising:

blades, each blade comprising a rotationally leading surface, a rotationally trailing surface, and a formation facing surface between the rotationally leading surface of the rotationally trailing surface, and fluid courses formed between the rotationally leading surfaces and the rotationally trailing surfaces of rotationally adjacent blades, the fluid courses comprising a fluid course surface;

cutting elements disposed on at least one of the blades; and at least one nozzle disposed on the bit body within at least one of the fluid courses and adapted to be in fluid communication with a source of drilling fluid, the at least one nozzle protruding from the fluid course surface such that a tip of the at least one nozzle is disposed at a distance from the fluid course surface that is greater than or equal to about 90% of a depth of the at least one of the fluid courses, wherein the at least one nozzle is configured to impact a formation with a stream of drilling fluid at a point rotationally in front of at least one cutting element of the cutting elements;

wherein the at least one cutting element is configured to cut into the formation and discharge cuttings from the formation into the stream of drilling fluid discharged by the at least one nozzle; and wherein the at least one cutting element is at a standoff distance from about 0.1" to about 3.0" from the at least one nozzle.

2. The earth-boring tool of claim 1, wherein an outlet of the at least one nozzle is at a setoff distance of about 0.2" to about 1.0" from the at least one cutting element.

3. The earth-boring tool of claim 1, wherein the at least one cutting element comprises:

a cutting face, the cutting face comprising:

a channel having a width and bisecting the cutting face, the channel being formed generally centrally on the cutting face; and a cutting tip at an end of the channel, the cutting tip having a width less than the width of the channel.

4. The earth-boring tool of claim 3, wherein the cutting face comprises a generally circular surface, the cutting face having a diameter of about 0.125" to about 1.000" and a cutting depth of about 0.010" to about 0.125"; and the channel comprises a depth of about 0.010" to about 0.100" and a width of about 0.125" to about 0.500".

5. The earth-boring tool of claim 1, wherein the at least one nozzle further comprises:

a generally circular opening for discharging the stream of drilling fluid; and a channel bisecting an end of the at least one nozzle comprising the opening, the channel having a depth of about 0.050" to about 1.000" and a width of about 0.050" to about 0.500".

6. The earth-boring tool of claim 5, wherein the at least one cutting element comprises a plurality of cutting elements each having a cutting face and the at least one nozzle is oriented such that a length of the channel is substantially parallel to a plane of at least two of the plurality of cutting faces that rotationally follow.

7. The earth-boring tool of claim 1, wherein the cutting element comprises a cutting face having a cutting tip and an opposite edge that is on an opposite side of the cutting face from the cutting tip, and wherein the tip of the at least one nozzle is at a height corresponding to a point from about 50% to about 90 percent of the distance from the opposite edge to the cutting tip of the at least one cutting element.

8. The earth-boring tool of claim 1, wherein the at least one nozzle further comprises a plurality of nozzles, each nozzle positioned at about the same radial distance from a central axis of the bit body.

9. The earth-boring tool of claim 8, wherein the plurality of nozzles are located in one or more of a cone region, a nose region, or a shoulder region of the of the bit body.

10. The earth-boring tool of claim 1, wherein the at least one nozzle further comprises a plurality of nozzles wherein a first nozzle of the plurality of nozzles is at a first radial distance from a central axis of the bit body and wherein a second nozzle of the plurality of nozzles is at a second radial distance from the central axis of the bit body different from the first radial distance.

11. An earth-boring tool, comprising:

a bit body comprising:

blades, each blade comprising a rotationally leading surface, a rotationally trailing surface, and a formation facing surface between the rotationally leading surface of the rotationally trailing surface, and fluid courses formed between the rotationally leading surfaces and the rotationally trailing surfaces of rotationally adjacent blades, the fluid courses comprising a fluid course surface;

cutting elements disposed on at least one of the blades, the cutting elements comprising a cutting face having a cutting tip and an opposite edge that is on an opposite side of the cutting face from the cutting tip, and wherein; and at least one nozzle disposed on the bit body within at least one of the fluid courses and adapted to be in fluid communication with a source of drilling fluid, the at least one nozzle protruding from the fluid course surface such that a tip of the at least one nozzle is disposed at a distance from the fluid course surface that is about 50% to 90% of a distance from the opposite edge to the cutting tip of the cutting face of the cutting elements, wherein the at least one nozzle is configured to impact a formation with a stream of drilling fluid at a point rotationally in front of at least one cutting element of the cutting elements;

wherein the at least one cutting element is configured to cut into the formation and discharge cuttings from the formation into the stream of drilling fluid discharged by the at least one nozzle; and wherein the tip of the at least one nozzle is at a setoff distance of about 0.2" to about 1.0" from the at least one cutting element.

12. The earth-boring tool of claim 11, wherein the at least one cutting element is at a standoff distance from about 0.1" to about 3.0".

13. The earth-boring tool of claim 11, wherein the at least one nozzle is configured to generate the stream of drilling fluid in a fan shape substantially parallel to the cutting face of the at least one cutting element.

14. A method of forming an earth-boring tool, comprising:

forming a bit body comprising:

blades, each blade comprising a rotationally leading surface, a rotationally trailing surface, and a formation facing surface between the rotationally leading surface of the rotationally trailing surface, and fluid courses formed between the rotationally leading surfaces and the rotationally trailing surfaces of rotationally adjacent blades, the fluid courses comprising a fluid course surface;

securing at least one cutting element to at least one of the blades; and securing at least one nozzle to the bit body in at least one of the fluid courses, the at least one nozzle adapted to be in fluid communication with a source of drilling fluid, the at least one nozzle protruding from the fluid course surface such that a tip of the at least one nozzle is disposed at a distance from the fluid course surface that is greater than or equal to about 90% of a depth of the at least one of the fluid courses, wherein the at least one nozzle is configured to discharge fluid impacting a formation at a point rotationally in front of the at least one cutting element;

wherein the at least one cutting element is configured to cut into the formation and discharge cuttings from the formation into the fluid discharged by the at least one nozzle such that the cuttings impact the formation at the point rotationally in front of the at least one cutting element; and wherein the tip of the at least one nozzle is at a setoff distance from about 0.2" to about 1.0" from the at least one cutting element.

15. The method of claim 14, wherein securing the at least one nozzle comprises forming a rectangular channel into a generally circular opening of the at least one nozzle, the rectangular channel bisecting the tip of the at least one nozzle comprising the opening, the rectangular channel having a depth of about 0.050" to about 1.000" and a width of about 0.050" to about 0.500".

16. The method of claim 14, wherein:

securing the at least one cutting element further comprises securing a plurality of cutting elements to the formation facing surface of the blades; and securing the at least one nozzle comprises securing the at least one nozzle to discharge the fluid impacting the formation at the point rotationally in front of at least two of the plurality of cutting elements.

17. The method of claim 14, wherein the at least one cutting element is positioned at a standoff distance from about 0.1" to about 3.0" rotationally behind the at least one nozzle.

18. The method of claim 14, wherein securing the at least one nozzle further comprises securing a plurality of nozzles to the bit body, each nozzle positioned at about the same radial distance from a central axis of the bit body.

19. The method of claim 18, wherein the plurality of nozzles are located in a cone region of the of the bit body.

20. The method of claim 14, wherein securing the at least one nozzle further comprises securing a plurality of nozzles to the bit body wherein a first nozzle the plurality of nozzles is at a first radial distance from a central axis of the bit body and wherein a second nozzle of the plurality of nozzles is at a second radial distance from the central axis of the bit body different from the first radial distance.

* * * * *